US005380166A

United States Patent [19]

Terauchi

[11] Patent Number: 5,380,166

[45] Date of Patent: Jan. 10, 1995

[54] PISTON TYPE REFRIGERANT COMPRESSOR

[75] Inventor: Kiyoshi Terauchi, Isesaki, Japan

[73] Assignee: Sanden Corporation, Gunma, Japan

[21] Appl. No.: 156,692

[22] Filed: Nov. 24, 1993

[30] Foreign Application Priority Data

Nov. 26, 1992 [JP] Japan ..... 4-316907

[51] Int. Cl.[6] ..... F04B 1/12

[52] U.S. Cl. ..... 417/269; 92/177; 91/499

[58] Field of Search ..... 417/222.1, 222.2, 269; 92/177; 91/489, 504, 505

[56] References Cited

U.S. PATENT DOCUMENTS 4,789,311 12/1988 Ikeda et al. ..... 417/269
4,963,074 10/1990 Sanuki et al. ..... 417/222.1
5,032,060 7/1991 Kobayashi et al. ..... 417/222.1
5,259,736 11/1993 Terauchi ..... 417/222.1

FOREIGN PATENT DOCUMENTS 4339183 11/1992 Japan ..... 417/269

*Primary Examiner*—Richard A. Bertsch

*Assistant Examiner*—Peter Korytnyk

*Attorney, Agent, or Firm*—Baker & Botts

[57] ABSTRACT

A piston type compressor housing encloses a crank chamber, a suction chamber, and a discharge chamber. The compressor housing includes a cylinder block. A plurality of cylinder bores are formed in the cylinder block in which a plurality of pistons are slidably disposed within the cylinder bores and have a corresponding axis. The drive shaft is rotatably supported in the cylinder block. A slant plate having an angle of tilt is tiltably connected to the drive shaft. A bearing couples the slant plate to the pistons, so that the pistons may reciprocate within the cylinder bores upon rotation of the slant plate. The pistons are adapted to be reciprocally moved in cylinder bores in accordance with the tilting motion of the slant plate. The cylinder bores include a cross-sectional plan which is disclosed by a plane perpendicular to the drive shaft. The cross-sectional plan includes an outline which defines a simple closed curve which is composed of a plurality of curves having varying radii of curvature. Accordingly, the compressor need not have separate piston rotation prevention means within cylinder bores.

8 Claims, 5 Drawing Sheets

PISTON TYPE REFRIGERANT COMPRESSOR

BACKGROUND OF THE INVENTION

1. Field of the Invention

The present invention generally relates to a piston type refrigerant compressor and, more particularly, to a slant plate type compressor, such as a swash or wobble plate type compressor, with a variable displacement mechanism suitable for use in an automotive air conditioning system.

2. Description of the Prior Art

A swash plate type refrigerant compressor with a variable displacement mechanism suitable for use in an automotive air condition system is disclosed in U.S. Pat. No. 4,789,311.

In a swash plate type compressor, the pistons reciprocate in cylinder bores and in response to the movement of a swash plate. The swash plate is fixedly secured to a drive shaft in such a manner as to be slanted with respect to the drive shaft. The pistons are coupled to the swash plate through bearing means comprising shoes. Referring to FIG. 9, a plurality of cylinder bores 87 are arranged in parallel with each other within cylinder block 3. Drive shaft 12 is arranged coaxially with the annular arrangement of cylinder bores 87. Pistons 67 are reciprocatingly inserted into cylinder bores 87. Pistons 67 are formed such that the middle portion of each piston 67, i.e., coupling portion 67*a*, is operatively connected with both sides of peripheral portion of swash plate 18 through shoes. Coupling portion 67*a* has a substantially semicircular cross-section, and two piston heads are coupled together through coupling portion 67*a*. Supporting portion 67*b* which is formed inside of coupling portion 67*a* supports the shoes. Cross-sections of cylinder bores 87 cut perpendicular to the longitudinal axis of drive shaft 12 are circular in shape. A clearance exists between the radial end extremity of swash plate 18 and each piston 67 because such swash plate type compressors with variable displacement typically require a relatively large clearance in order to vary the capacity of compression by changing the piston stroke.

In this configuration, the relatively large clearance allows pistons 67 to rotate within cylinder bores 87 and create noise due to collisions between the inner surface 67*c* of each piston 67 and the radial end extremity of the swash plate 18. As a result, an expensive wear resistant coating must be applied to prevent wear of inner surface 67*c*. Further, each piston 67 must be provided with a rotation prevention mechanism to prevent the noise described above. As a result, the structure of the compressor becomes more complex, and the manufacturing process of such compressors becomes more complicated. Because of this complex structure and the complicated manufacturing process, the associated manufacturing cost increases greatly, and the productivity of manufacturing facilities declines.

SUMMARY OF THE INVENTION

It is an object of the present invention to provide a piston type compressor which does not have separate piston rotation prevention mechanisms within cylinder bores.

It is another object of the present invention to provide a piston type compressor which can obtain a maximum compression capacity and maintain a constant capacity of the compressor.

It is a further object of the present invention to provide a piston type compressor which does not generate excessive vibration and noise.

According to the present invention, a compressor housing encloses a crank chamber, a suction chamber, and discharge chamber. The compressor housing includes a cylinder block. A plurality of cylinder bores are formed in the cylinder block. A plurality of pistons are slidably disposed within the cylinder bores. Each of the pistons has a longitudinal axis. The drive shaft is rotatably supported in the cylinder block. A slant plate is tiltably connected to the drive shaft. A bearing couples the slant plate to the pistons, so that the pistons may be driven in a reciprocating motion within the cylinder bores upon rotation of the slant plate. At least one working chamber is defined by an end of each of the pistons and an inner surface of the corresponding cylinder bores. A support portion is disposed coaxially with the drive shaft and tiltably supports a central portion of the slant plate.

The pistons are adapted to be reciprocally moved in the cylinder bores in accordance with a tilting motion of the slant plate. A cross-sectional plan is defined by a plane perpendicular to the drive shaft and intersecting the cylinder bores. The cross-sectional plan includes an outline of the cross-sections of the cylinder bores. These outlines are not circular in shape, but instead are shaped as simple closed curves which are composed of a plurality of curves having varying radii of curvature.

Both swash plate and wobble plate type compressors include a slant plate disposed at a slant or tilt angle relative to the drive shaft. The wobble plate nutates but does not rotate and drivingly couples the pistons to the drive shaft. The swash plate, however, nutates and rotates. A slant plate type compressor includes any type of compressor which uses a slanted plate or surface in its drive mechanism.

Further objects, features, and advantages of the present invention will be understood from the detailed description of preferred embodiments of the present invention with reference to the drawings.

DETAILED DESCRIPTION OF PREFERRED EMBODIMENTS

Figure 1:
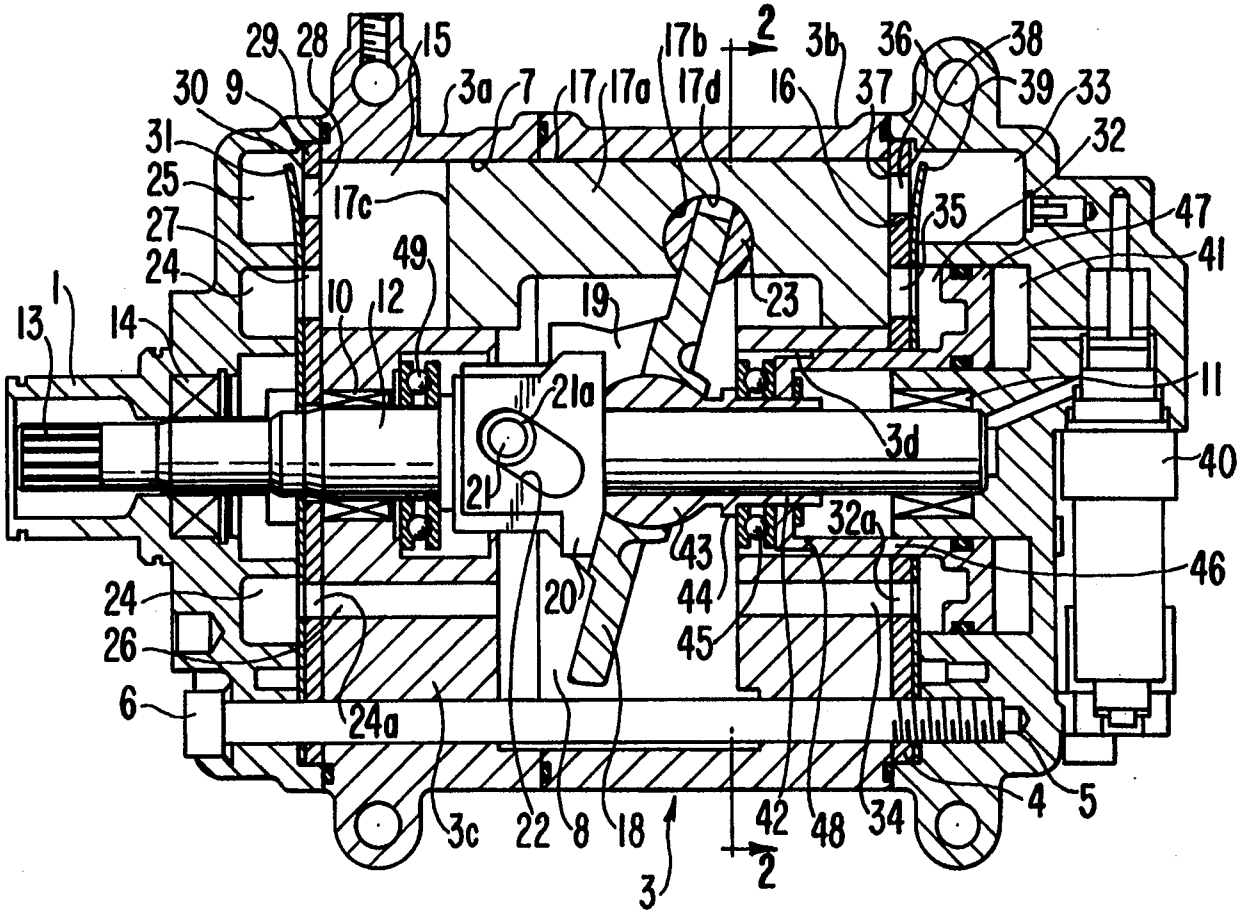
FIG. 1 is a longitudinal sectional view of a swash plate refrigerant compressor with a variable displacement mechanism in accordance with the present invention.

Referring to FIG. 1, an outer shell of the compressor is formed by front housing 1, front valve plate 2, cylinder block 3, rear valve plate 4, and rear housing 5, which preferably are made of an aluminum alloy. When discussing FIG. 1, the right-hand side of the figure is the "rear" side, and the left-hand side is the "front" side. Cylinder block 3 is formed of front cylinder block 3*a* and rear cylinder block 3*b*, which abut each other. Front housing 1 is mounted to front valve plate 9 on one side of cylinder block 3, and rear housing 5 is mourned to rear valve plate 4 on the other side of cylinder block 3. These outer shell components are coupled as a unit by a plurality of bolts 6.

A plurality of cylinder bores 7 each having an axis are arranged in parallel with each other. Cylinder bores 7 and chamber 8 are formed within cylinder block 3 by front and rear cylinder blocks 3*a* and 3*b*. Further, first bearing 10 and second bearing 11 are disposed in cylinder block 3 and rear housing 5, respectively, to rotatably support drive shaft 12. Drive shaft 12 is arranged coaxially with the annular configuration of cylinder bores 7. An end portion 13 of drive shaft 12 extends outside of front housing 1 through drive shaft sealing bearing 14 mounted on front housing 1. Exposed end portion 13 is connected to an electromagnetic clutch (not shown), so that the rotational torque of an automotive engine (not shown) may be transmitted to drive shaft 12 through the electromagnetic clutch.

Piston 17 defines a front side working chamber 15 and a rear side working chamber 16 in cooperation with an inner surface of each cylinder bore 7. Piston 17 is reciprocatingly inserted into each cylinder bore 7. Thus, each piston 17 may be reciprocated by swash plate 18 which is disposed within crank chamber 8.

Swash plate 18 has a projection at its central region, and arm 19 is formed in the projection. Planar plate portion 20 is formed in drive shaft 12 at a position corresponding to arm 19 of swash plate 18. Swash plate 18 is obliquely mounted on drive shaft 12 with planar plate portion 20 engaged with arm 19. Also, pin 21 is fixed to the projection portion of swash plate 18. Pin 21 is engaged by means of a collar 21*a* with elongated hole 22 formed in planar plate portion 20 of drive shaft 12. In this configuration, swash plate 18 is shifted between a position in which the slant angle is large and a position in which the slant angle is small, while pin 21 of swash plate 18 slides within elongated hole 22. The capacity of the compressor depends upon the slant angle of swash plate 18. When the slant angle of swash plate 18 increases, the stroke length of piston 17 in cylinder bore 7 is maximized, and the capacity of the compressor decreases.

The rotational force of drive shaft 12 is transmitted to swash plate 18 through the engagement between planar plate portion 20 and arm 19. Swash plate 18 is driven to rotate with drive shaft 12 about the longitudinal axis of drive shaft 12 such that swash plate 18 nutates in the axial direction of drive shaft 12. Thus, swash plate 18 is swung between a rightwardly upward inclination and a leftwardly downward inclination.

The circumferential peripheral portion of swash plate 18 is connected to piston 17 through a pair of shoes 23. Swash plate 18 is inserted slidingly into the space between the pair of shoes 23. Shoes 23 form a single spherical shape when in contact with swash plate 18 and are rotatably mounted in a complementary manner in recesses formed in piston 17. Accordingly, the swing (or reciprocating) motion concomitant with the rotation of swash plate 18 is transmitted to piston 17 through shoes 23. The rotational component of the motion of swash plate 18, however, is not transmitted to shoes 23. Pistons 17 are reciprocated within cylinder bores 7, so that the volumes of front side working chambers 15 and rear side working chambers 16 are alternatively increased and decreased.

Front housing 1 defines front suction chamber 24 and front discharge chamber 25. Drive shaft sealing bearing 14 is provided between front suction chamber 24, drive shaft 12, and front housing 1 to prevent the refrigerant, e.g., a mixture of refrigerant and lubricant, from leaking from the compressor. Front suction chamber 24 communicates with crank chamber 8 through a hole 24*a* formed in front valve plate 9 and front passage 26 formed in cylinder block 3. Further, front suction chamber 24 communicates with front side working chambers 15 through front suction holes 27 formed in front valve plate 9. Also, front discharge chamber 25 communicates with front side working chambers 15 through discharge holes 28 formed in front valve plate 9.

Front suction valve 29, in the form of a flexible sheet of material, is provided on the surface of front valve plate 9 within front side working chambers 15, so that front suction valve 29 is opened when piston 17 moves rightwardly to increase the volume of chambers 15. Sheet-like discharge valve 30 is provided on the surface of front valve plate 9 within discharge chamber 25, so that discharge valve 30 is opened when piston 17 moves leftwardly to decrease the volume of chambers 15. Discharge valve 30 is restrained by valve retainer 31.

Rear housing 5 defines rear suction chamber 32 and rear discharge chamber 33. Rear suction chamber 32 communicates with crank chamber 8 through a hole 32*a* formed in rear valve plate 4 and a rear passage 34 formed in cylinder block 3. Further, rear suction chamber 32 communicates with rear side working chambers 16 through rear suction holes 35. Rear discharge chamber 33 communicates with rear side working chambers 16 through discharge holes 36 formed in rear valve plate 4. Rear suction valve 37, rear discharge valve 38, and rear valve retainer 39 are provided on rear valve plate 4 in similar manner to that described for the corresponding front elements.

Switching valve 40 and control chamber 41 also are provided in rear housing 5. Slider 42 is rotatably mounted on drive shaft 12 and is slidable in the axial direction of drive shaft 12. Slider 42 is provided with spherical support portion 43 at one end thereof close to planar plate portion 20 of drive shaft 12. Spherical support portion 43 permits the central region of swash plate 18 to rotate about the axis of drive shaft 12 and to move in the axial direction. Slider 42 has flange portion 44 which is connected to one end of spool 46 through second thrust bearing 45.

Spool 46 has annular piston portion 47 which is formed at outer end of spool 46 and separates rear suction chamber 32 from control chamber 41. Cylindrical portion 48 extends coaxially with drive shaft 12 and slider 42 from piston portion 47 to the interior of cylinder block 3. Cylindrical portion 48 of spool 46 is slidably inserted into cylindrical portion 3*d* formed in cylinder block 3*b*. Thus, the motion of spool 46 in the axial direction is transmitted to slider 42 through second thrust bearing 45 and flange portion 44. First thrust bearing 49 is also provided on drive shaft 12 on the side of planar plate portion 20 and is clamped between planar plate portion 20 of drive shaft 12 and retainer shoulder 3*c* provided in front cylinder block 3*a* to impart thrust to drive shaft 12.

Piston 17 includes piston head 17*c* at each end. Piston 17 is formed such that the middle portion of piston 17, namely coupling portion 17*a*, is operatively connected with both sides of the peripheral portion of swash plate 18 through shoes 23. Coupling portion 17*a* has a substantially semicircular cross-section and couples two piston heads 17*c* together. Supporting portion 17*b*, which is formed inside of coupling portion 17*a*, supports shoes 23. Also, piston 17 is provided with a piston ring (not shown) which is made of flexible material, such as Teflon® resin or PTFE.

The operation of this compressor will now be described. Referring again to FIG. 1, when the above described electromagnetic clutch is engaged to transmit the drive torque from the automotive engine, drive shaft 12 begins to rotate within cylinder block 3. The rotation of drive shaft 12 is transmitted to arm 19 and swash plate 18 to rotate swash plate 18. Because, swash plate 18 is slanted relative to drive shaft 12, swash plate 18 is swung in accordance with the rotation of drive shaft 12, so that pistons 17 are reciprocated within cylinder bores 7 in response to this swing motion.

When the discharge displacement of the compressor must be kept at a maximum level, switching valve 40 is operated to place control chamber 41 in communication with rear discharge chamber 33. The pressure applied to the right side of piston portion 47 of spool 46 is higher than the compressor pressure and switching valve 40 is switched over so as to place control chamber 41 in communication with rear discharge chamber 33. When the pressure is applied to the right side of piston portion 47 of spool 46 is higher than the pressure applied to the left side, spool 46 moves leftward. At the same time, the central region of swash plate 18 and slider 42 also moves leftward, so that the left end of slider 42 is brought into contact with planar plate portion 20 of drive shaft 12. By the leftward movement of swash plate 18, the projection portion of swash plate 18 having pin 21 is moved leftward relative to planar plate portion 20 of drive shaft 12, so that pin 21 is moved along elongated hole 22 of planar plate portion 20 toward the left upward end. In accordance with the leftward and upward movement of pin 21, swash plate 18 is pivoted about the center of spherical support portion 43 of slider 42 to attain a large slant angle.

As pistons 17 reciprocate, the refrigerant is alternately drawn into and compressed within front and rear side working chambers 15 and 16. The refrigerant is introduced to the compressor from the refrigerant cycle through crank chamber 8 to front and rear suction chambers 24 and 32 and exits to the refrigerant cycle through front and rear discharge chambers 25 and 33. As described above, swash plate 18 is moved in the axial direction along drive shaft 12, so that the slant angle is a greatly varied, and the central region is located substantially at the center in the longitudinal direction of cylinder bores 7. Therefore, as each piston 17 reciprocates through a complete stroke, a loss of compression is avoided in front and rear side working chambers 15 and 16. The refrigerant compressed in this manner is discharged from either front or rear side working chambers 15 and 16. Accordingly, the refrigerant flow is generated in either front or rear side working chambers 15 and 16, drive shaft sealing bearing 14 is in contact with the flowing refrigerant, and the heat generated due to the friction with drive shaft 12 is removed by the refrigerant.

When the discharge displacement of the compressor must be kept at a minimum level, the operation of switching valve 40 places control chamber 41 communication with rear discharge chamber 33. When drive shaft 12 is rotated, swash plate 18 causes piston 17 to move rightward. As a result of the reactive force applied to piston 17, a force is applied to swash plate 18 to decrease the inclination angle of swash plate 18. Accordingly, the force for rotating swash plate 18 is applied to swash plate 18 in a counterclockwise direction by piston 17.

The force applied to swash plate 18 is limited because pin 21 is slidingly engaged with elongated hole 22, and a force is created which presses the central region of swash plate 18 to the right in the axial direction of drive shaft 12. The force component is transmitted to spool 46 through slider 42. As described above, because of the pressure difference between both sides of the piston portion 47 of spool 46, piston portion 47 moves rightward. Thus, the inclination angle of swash plate 18 is decreased and, at the same time, the central portion of swash plate 18 is moved toward the rear side working chambers 16. The dead center position in rear side working chamber 16 is kept at substantially the same position as in the case of the above-described maximum displacement operation. Further, each piston 17 includes inner surface 17*d* formed on the inside thereof. Preferably, a clearance of about 2 or 3 mm (0.08 or 0.12 inches) exists between radial end extremity 18*a* of swash plate 18 of each piston 17 because a swash plate compressor with variable displacement typically requires a relatively large clearance to vary the capacity of compression by changing the piston stroke. Unfortunately, this relatively large clearance might allow piston 17 to rotate within circular cylinder bores 7 and create noise due to collisions between inner surface 17*d* of piston 17 and radial end extremity 18*a* of swash plate 18.

Figure 2:
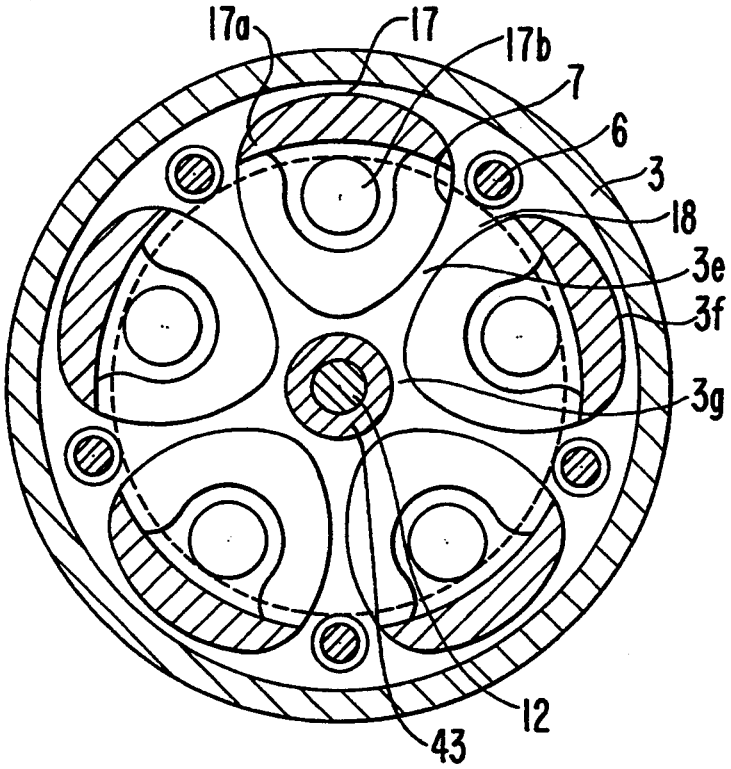
FIG. 2 is a cross-sectional plan taken along line 2—2 in FIG. 1 in accordance with a first embodiment of the present invention.
Figure 3:
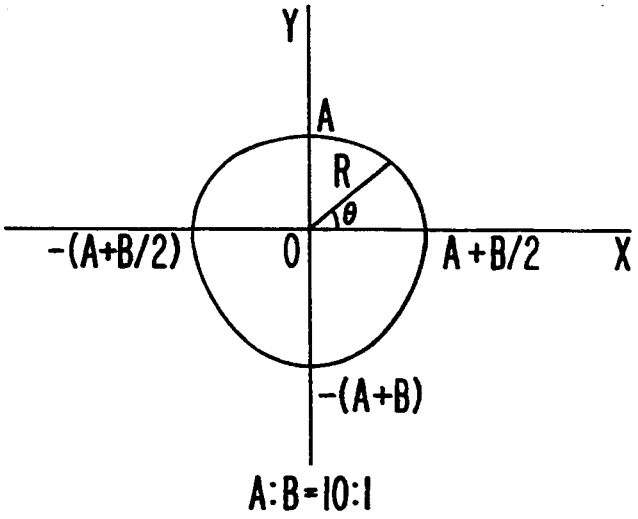
FIG. 3 is a diagrammatic illustration of the outline of the cylinder bores in accordance with the first embodiment of the present invention.

FIGS. 2 and 3 illustrate a first embodiment of the present invention. A cross-sectional plan of cylinder bores 7 taken on a plane perpendicular to drive shaft 12 includes an outline of the shape of the cylinder bores 7 formed as a simple closed curve, rather than as a circle. The simple closed curve is defined by the following equation in polar coordinates:

$$R = A + \frac{B}{2}(1 + \sin 3\theta) \quad (1)$$

In Equation (1), R is the unknown distance from the center of the simple closed curve, e.g., the axis of cylinder bore 7. A and B are known coefficients and positive numbers. Further, $\theta$ is a displacement angle. The closed curve generated when the ratio of A:B is 10:1 is depicted in FIG. 3.

The simple closed curve is designed to synthesize a first curve which is positioned nearer to drive shaft 12 and a second curve which is positioned further from drive shaft 12. The radius of curvature of the first curve is smaller than that of the second curve, and the simple closed curve defined by the equation above is generally oval shaped. The closed curve intersects the x-axis at $$A + \frac{B}{2} \text{ and } -\left(A + \frac{B}{2}\right)$$

and the y-axis at A and −(A+B). Preferably, a cross-sectional plan of pistons 17, which are disposed in cylinder bores 7, corresponds precisely to the cross-sectional plan of cylinder bores 7.

In this configuration, inner surface 17*d* of piston 17 need not receive a wear resistant coating, such as a Teflon® resin or PTFE, to prevent wear of inner surface 17*d* of piston 17. Moreover, each piston 17 need not be provided with rotation prevention means because contrary to the prior art, cross-sectional plans of cylinder bores 7 and piston 17 are not circular and, therefore, pistons 17 do not rotate within cylinder bores 7. The cross-sectional plan of cylinder bores 7 may be expanded until it approaches the outline of cylinder block. As a result, the cross-sectional plan of coupling portion 17*a* of piston 17 can have a broad area in comparison to the prior art. Piston 17 thus may obtain a high breaking strength. Further, this improvement reduces the propagation of an offensive noise and prevents the vibration of the compressor because no collisions occur between inner surface 17*d* of piston 17 and radial end extremity 18*a* of swash plate 18.

Cylinder block wall 3*e*, which is formed between neighboring cylinder bores 7, should have a minimum thickness in order to maintain the strength of the compressor. See FIG. 2. Cylinder block wall 3*f*, which is formed between an outer radial surface of cylinder bores 7 and an outer end of cylinder block 3, also should have a minimum thickness in order to maintain the strength of the compressor. Further, the portion of cylinder block 3 which is formed between an inner radial surface of cylinder bores 7 and an outer end of drive shaft 12 should have a minimum thickness in order to maintain the strength of the compressor. Therefore, when a plurality of cylinder bores 7 are formed in cylinder block 3, the cross-sectional plan of cylinder bores 7 describes a compression capacity which is larger than that of cylinder bores 87 in the prior art.

Figure 4:
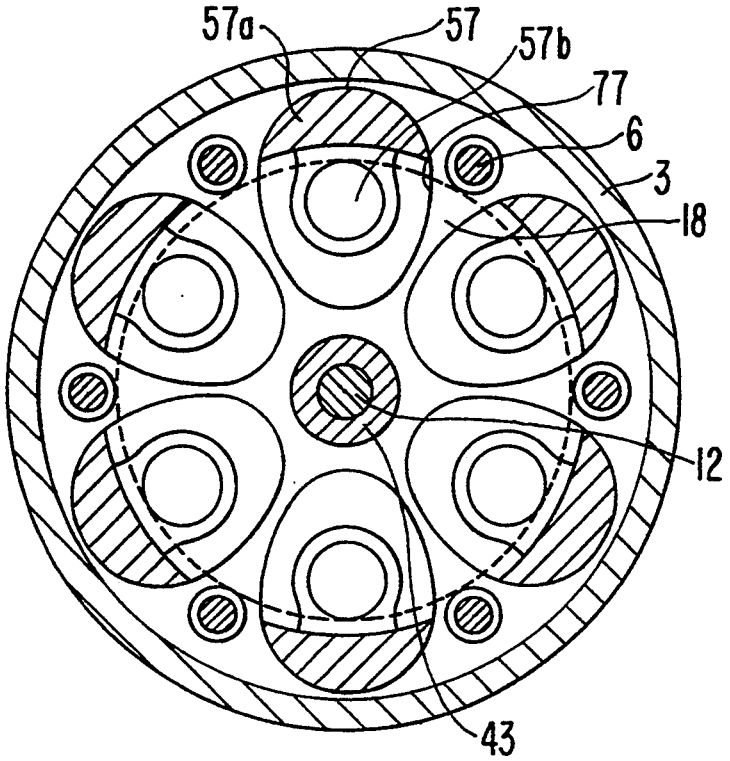
FIG. 4 is a cross-sectional plan taken along line 2—2 in FIG. 1 in accordance with a second embodiment of the present invention.
Figure 5:
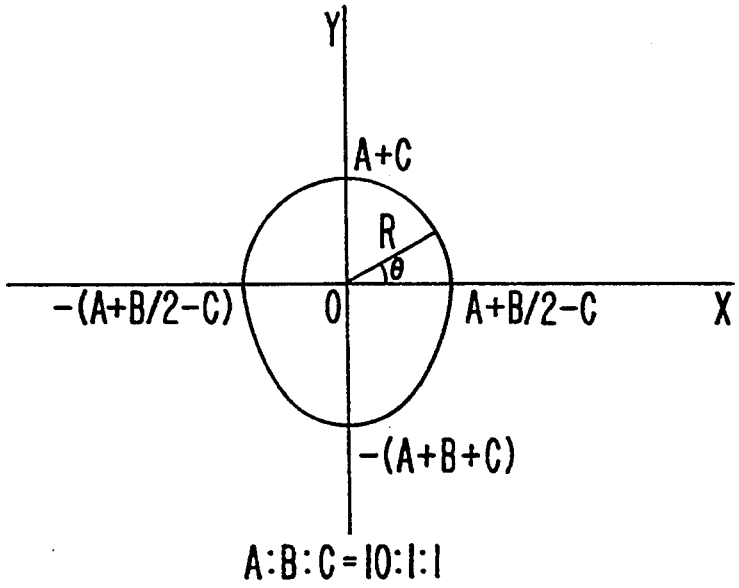
FIG. 5 is a diagrammatic illustration of the outline of the cylinder bores in accordance with the second embodiment of the present invention.

FIGS. 4 and 5 illustrate a second embodiment of the present invention. The cross-sectional plan of cylinder bores 77 describes the closed curve which is defined by the following equation in polar coordinates:

$$R = A + \frac{B}{2}(1 + \sin 3\theta) + C\sin\left(2\theta + \frac{3}{2}\pi\right) \quad (2)$$

In Equation (2), R, A, B, and $\theta$ are as defined in Equation (1). C is a known coefficient and a positive number. The simple closed curve defined by this equation is composed of an ellipse and an oval. This simple closed curve has a length on the major axis, its y-axis, which is longer than that of the first embodiment, and a width on the minor axis, its x-axis, which is shorter than that of the first embodiment. When many pistons must be provided in cylinder block 3, this configuration achieves a compression capacity different from the first embodiment.

Figure 6:
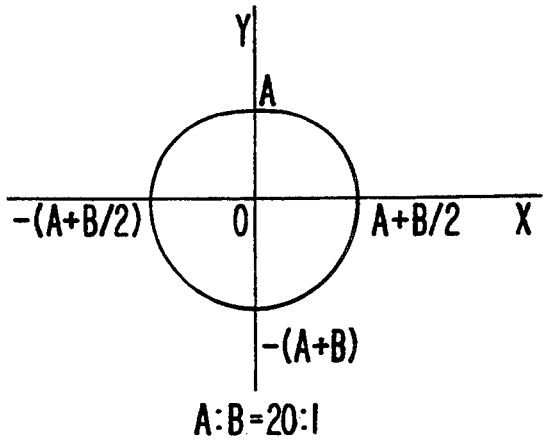
FIG. 6 is a diagrammatic illustration of the outline of the cylinder bores in accordance with a third embodiment of the present invention.
Figure 7:
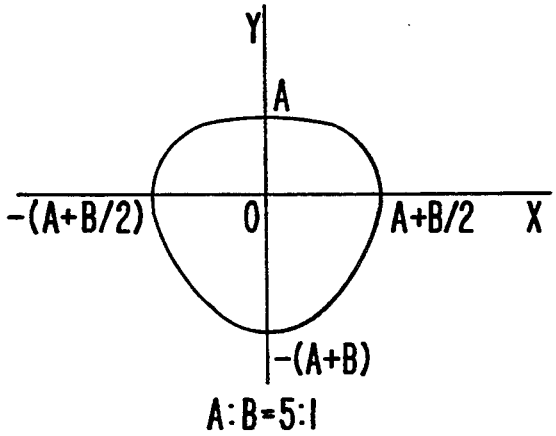
FIG. 7 is a diagrammatic illustration of the outline of the cylinder bores in accordance with a fourth embodiment of the present invention.

FIGS. 6 and 7 respectively illustrate a fourth and fifth embodiment of the present invention which are similar to the first embodiment. Referring to Equation (1), FIGS. 6 and 7 describe embodiments in which the ratio A:B is 20:1 and 5:1, respectively.

Figure 8:
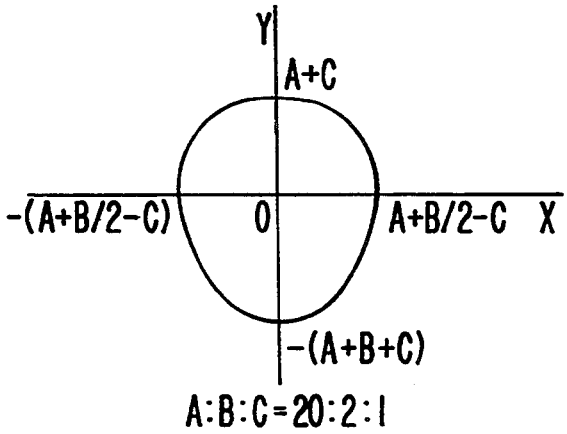
FIG. 8 is a diagrammatic illustration of the outline of the cylinder bores in accordance with a fifth embodiment of the present invention.
Figure 9:
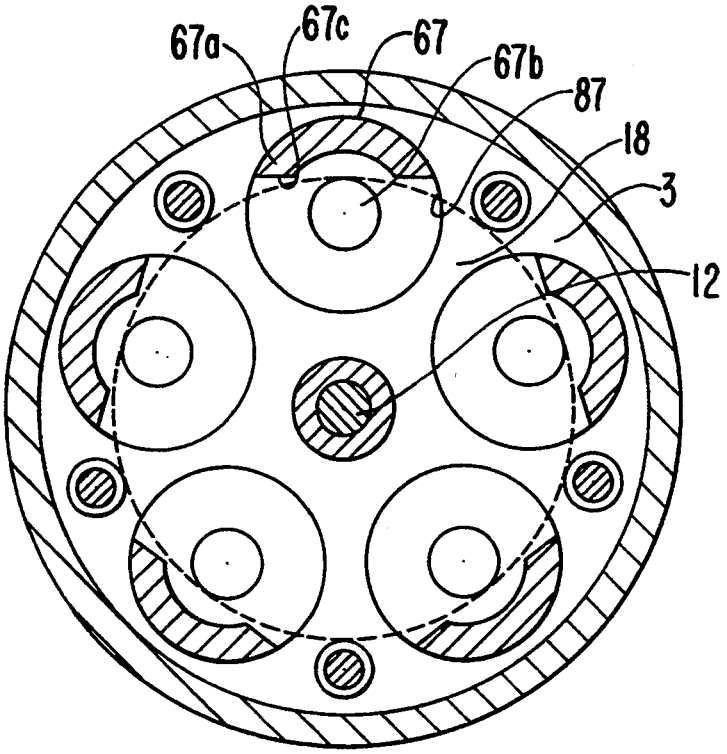
FIG. 9 (PRIOR ART)
FIG. 9 is a cross-sectional plan, similar to the view taken along line 2—2 in FIG. 1, in accordance with a prior art design.

FIG. 8 illustrates a sixth embodiment of the present invention which is similar to the second embodiment. Referring to Equation (2), FIG. 8 describes an embodiment in which the ratio A:B:C is 20:2:1.

Although the present invention has been described in detail in connection with the preferred embodiments, the invention is not limited thereto. Specifically, while the preferred embodiments illustrate the invention in a swash plate type compressor, this invention is not restricted to a swash plate type refrigerant compressor, but may be employed in other piston type refrigerant compressors. It will be easily understood by those of ordinary skill in the art that variations and modifications can be easily made within the scope of this invention as defined by the appended claims. Accordingly, the embodiments and features disclosed herein are provided by way of example only. It is to be understood that the scope of the present invention is not to be limited thereby, but is to be determined by the claims which follow.

I claim:

1. A piston type refrigerant compressor comprising:

a compressor housing enclosing a crank chamber, a suction chamber, and a discharge chamber said compressor housing including a cylinder block;

a plurality of cylinder bores formed in said cylinder block;

a plurality of pistons slidably disposed within said cylinder bores, each of said pistons having a longitudinal axis;

a drive shaft rotatably supported in said cylinder block;

a plate having an angle of tilt and tiltably connected to said drive shaft:

a bearing coupling said plate to said pistons, so that said pistons reciprocate within said cylinder bores upon rotation of said plate;

at least one working chamber defined by an end of each of said pistons and an inner surface of said corresponding cylinders;

a support portion disposed coaxially with said drive shaft and tiltably supporting a central portion of said plate;

a tilt control device driving said support portion axially along said drive shaft to move said central portion of said plate axially along said drive shaft to change the angle of tilt of said plate, said pistons reciprocating in said cylinder bores in accordance with changes in the angle of tilt of said plate; and said cylinder bores including a cross-sectional plan defined by a plane perpendicular to said drive shaft, said cross-sectional plan of each of said cylinder bores having an outline defining a closed curve, wherein said closed curve is composed of a plurality of curves having varying radii of curvature.

2. The piston type compressor of claim 1, wherein said closed curve synthesizes a first curve which is nearer said drive shaft and a second curve farther from said drive shaft, said first curve having a radius of curvature which is smaller than that of a second curve.

3. The piston type compressor claim 1, wherein said closed curve is defined by an equation $$R = A + \frac{B}{2}(1 + \sin 3\theta)$$

wherein R is a varying distance from a center of said closed curve, A and B are known coefficients and positive numbers, and $\theta$ is a displacement angle.

4. The piston type compressor of claim 1, wherein said closed curve is defined by an equation $$R = A + \frac{B}{2}(1 + \sin 3\theta) + C\sin\left(2\theta + \frac{3}{2}\pi\right)$$

wherein R is a varying distance from a center of said closed curve; A, B, and C are known coefficients and positive numbers; and $\theta$ is a displacement angle.

5. A swash plate type refrigerant compressor comprising:

a pair of axially combined front and rear cylinder blocks forming therein a plurality of cylinder bores and a swash plate compartment:

a pair of front and rear housings arranged at axial ends of said combined cylinder blocks, each housing having therein a suction chamber and a discharge chamber;

a pair of valve plates interposed between said front and rear housings and said axial ends of said combined cylinder blocks, respectively;

a drive shaft extending axially through said swash plate compartment of said combined cylinder blocks;

a swash plate in said swash plate compartment supported on said drive shaft and rotatable therewith, a plurality of pistons engaged with said swash plate so as to reciprocate in said cylinder bores with the rotation of said swash plate, each piston comprising a pair of head portions at the opposite ends thereof which are connected together by an intermediate portion of said piston; and, said cylinder bores including a cross-sectional plan defined by a plane perpendicular to said drive shaft, said cross-sectional plan of each of said cylinder bores having an outline defining a closed curve, wherein said closed curve is composed of a plurality of curves having varying radii of curvature.

6. The swash plate type compressor of claim 5, wherein said closed curve synthesizes a first curve which is nearer said drive shaft and a second curve farther from said drive shaft, said first curve having a radius of curvature which is smaller than that of a second curve.

7. The swash plate type compressor of claim 5, wherein said closed curve is defined by the equation $$R = A + \frac{B}{2}(1 + \sin 3\theta)$$

wherein R is a varying distance from a center of said closed curve, A and B are known coefficients and positive numbers, and $\theta$ is a displacement angle.

8. The swash plate type compressor of claim 5, wherein said closed curve is defined by the equation $$R = A + \frac{B}{2}(1 + \sin 3\theta) + C\sin\left(2\theta + \frac{3}{2}\pi\right)$$

wherein R is a varying distance from a center of said closed curve; A, B, and C are known coefficients and positive numbers; and $\theta$ is a displacement angle.

* * * * *